US005303488A

United States Patent [19]

Todd et al.

[11] Patent Number: 5,303,488

[45] Date of Patent: Apr. 19, 1994

[54] PICTURE FRAME

[75] Inventors: Harold F. Todd, Midland; David C. LeFeaver, Toronto, both of Canada

[73] Assignee: Kleco Corporation, Brecksville, Ohio

[21] Appl. No.: 682,590

[22] Filed: Apr. 8, 1991

[51] Int. Cl.[5] ..... G09F 01/12

[52] U.S. Cl. ..... 40/152; 40/159.1

[58] Field of Search ..... 40/155, 152, 152.1, 40/158.1, 159.1, 156

[56] References Cited

U.S. PATENT DOCUMENTS

| | | | |
|---|---|---|---|
| 1,463,150 | 7/1923 | Carlsen | 40/152 |
| 2,996,159 | 8/1961 | Casebolt | 40/156 X |
| 4,124,323 | 11/1978 | Freeman | 40/155 X |
| 4,840,342 | 6/1989 | Sweeny et al. | 40/152 X |

FOREIGN PATENT DOCUMENTS

| | | | |
|---|---|---|---|
| 1393511 | 2/1965 | France | 40/152 |
| 2233140 | 1/1991 | United Kingdom | 40/152 |

*Primary Examiner*—Kenneth J. Dorner
*Assistant Examiner*—J. Bonifanti
*Attorney, Agent, or Firm*—Tarolli, Sundheim & Covell

[57] ABSTRACT

An apparatus for framing a member, such as a picture, includes a first element for engagement with the member. The first element has an elongate recess. A second element has a different aesthetic appearance than the first element. The second element includes a portion which extends into the recess of the first element. The first element has means for lockingly engaging the second element to secure the first and second elements together.

15 Claims, 3 Drawing Sheets

PICTURE FRAME

BACKGROUND OF THE INVENTION

The present invention relates to an apparatus for bordering a member such as a picture or the like, and in particular relates to a picture frame.

Picture frames are commonly rectangular in shape and include four border members which are joined together. Each of the four border members is usually straight and has ends which are angled at a 45° angle to mate with adjacent border members.

Border members for a picture frame are made of a variety of materials, such as wood, plastic, metal or combinations of such materials. Border members which are made of a combination of materials have an advantage in that a first material can be used for a base portion of the border member, and a second material can be used as a trim portion of the border member for aesthetic appearance. The material of the trim portion can be selected purely for aesthetic appeal. For example, the base portion may be metal and the trim portion may be wood, to take advantage of the natural beauty of wood. U.S. Pat. No. 4,850,125 discloses a picture frame having border members made of metal with a wood trim.

SUMMARY OF THE INVENTION

The present invention is an apparatus for framing or bordering a member, such as a picture. The apparatus includes a first element for engagement with the member. The first element has an elongate recess. The apparatus includes a second element which has a different aesthetic appearance than the first element. The second element includes a portion which extends into the recess of the first element. The first element includes means for lockingly engaging the second element. The locking engagement secures the first and second elements together to prevent relative movement between the first and second elements. Preferably, the first element is made of metal and the second element is made of wood.

Also, preferably, the means on the first element for lockingly engaging the second element is a projection on the first element which extends into a groove in the second element. The projection has at least one barb which penetrates into the material of the second element to lock the first and second elements against relative movement.

BRIEF DESCRIPTION OF THE DRAWINGS

The foregoing and other features of the present invention will become more apparent to one skilled in the art upon a consideration of the following description of the invention with reference to the accompanying drawings, in which.

DESCRIPTION OF A PREFERRED EMBODIMENT

Figure 1:
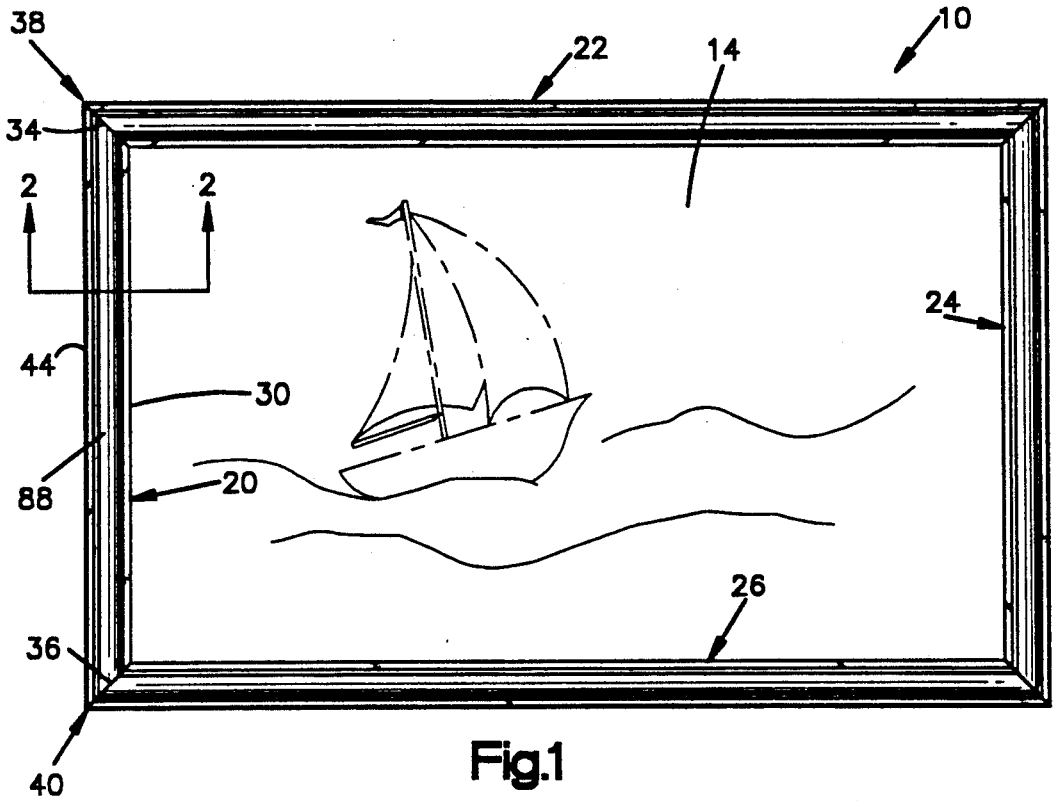
FIG. 1 is a pictorial illustration of a picture in a frame embodying the present invention.

The present invention relates to an apparatus for bordering a member. The apparatus may be used in a variety of ways and may have a variety of constructions. By way of example, the present invention is illustrated in FIG. 1 as embodied in a picture frame 10. The picture frame 10 borders and supports a picture 14. The picture frame 10 is comprised of four border members 20, 22, 24, 26. Each of the four border members 20, 22, 24, 26 is similarly constructed. Therefore, only border member 20 will be described in detail.

Border member 20 is essentially straight and extends along one side 30 of the picture 14. The border member 20 is cut at a 45° angle at both ends 34, 36 to mate with ends of adjacent border members 22, 26, respectively, to form two corners 38, 40 of the picture frame 10. The ends of border members 22, 26 which mate with the ends 34, 36 of the border member 20 are also cut at a 45° angle.

The border member 20 includes a first element 44 for supporting the picture 14 along the side 30 of the picture. The first element 44 is preferably made of metal and has an outer surface with an aesthetically pleasing appearance, such as a polished brass appearance. Alternatively, the first element 44 could be made of other material, such as plastic, and could have an outer surface which is plated, painted or textured. In the preferred embodiment, the first element 44 is an extruded one-piece anodized aluminum part.

The first element 44 has an outer side portion 48 (FIG. 2) with an exposed surface 50. The outer side portion 48 partially defines a channel 52 in the first element 44. The outer side portion 48 and channel 52 extend the entire length of the first element 44.

The first element 44 also has an upper (as viewed in FIGS. 2 and 3) portion 54 with outer surface portions 56, 58 which face in the same direction the picture 14 faces. The outer surface portions 56, 58 lie in a plane substantially perpendicular to the outer side portion 48 and extend the entire length of the first element 44. The upper portion 54 also has surface portions 62, 64, 66, 68 which define an elongate recess 72 in the first element 44. The recess 72 extends the entire length of the first element 44. Surface portions 64, 66 extend along a closed end 74 of the recess 72 and are substantially parallel to surface portions 56, 58. Surface portions 62, 68 are parallel to each other and extend substantially perpendicular to surface portions 56, 58.

Figure 2:
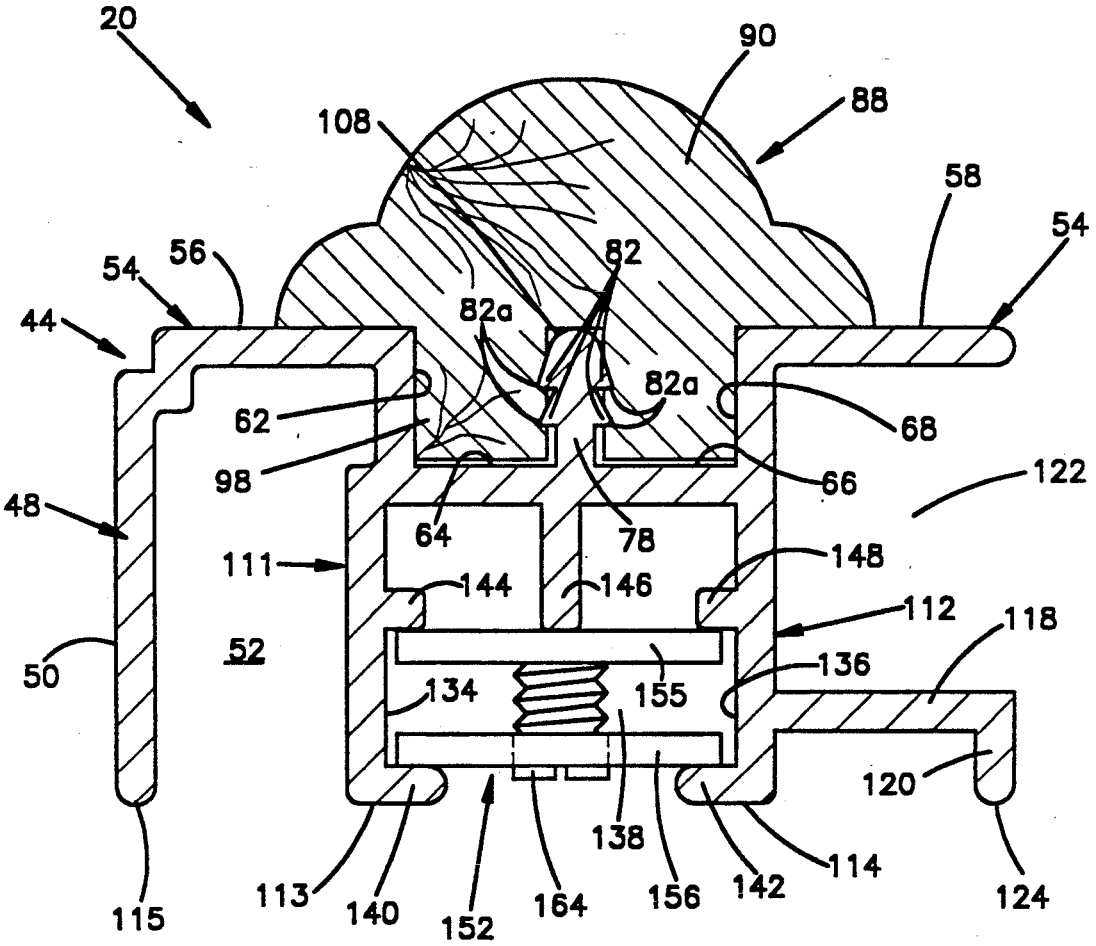
FIG. 2 is an enlarged, sectional view taken along line 2—2 of FIG. 1 with the picture omitted.
Figure 3:
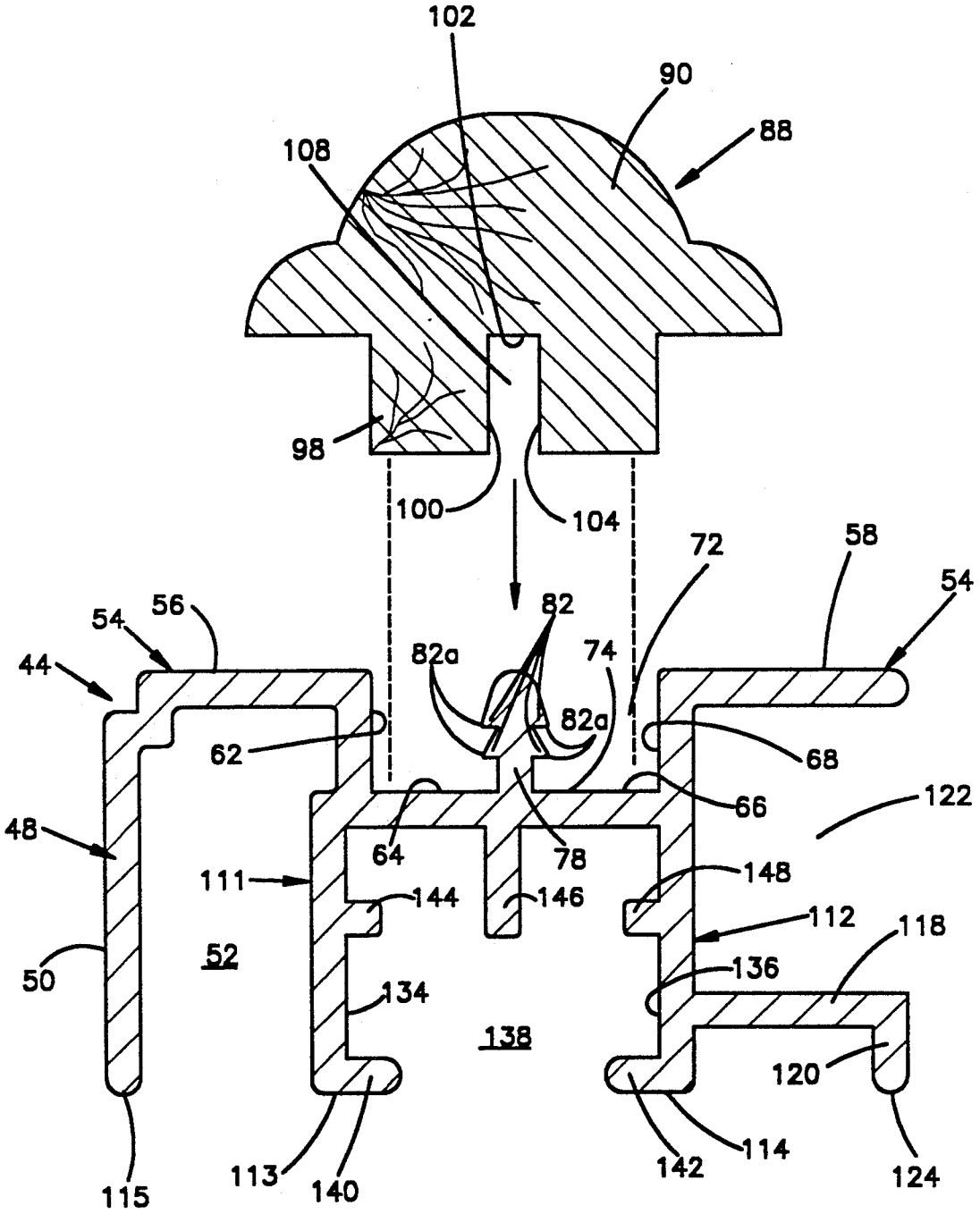
FIG. 3 is an exploded, sectional view of the parts shown in FIG. 2.

Extending from the closed end 74 of the recess 72 is a projection 78. The projection 78 is disposed within the recess 72 and preferably extends along the entire length of the first element 44. The projection 78 is located centrally between surfaces 62 and 68 and extends substantially perpendicular to the surfaces 64, 66. Disposed on both sides of the projection 78 are a plurality of barbs 82. As shown in FIGS. 2 and 3, there are two barbs 82 on each side of the projection 78. The barbs 82 extend for the entire length of the projection 78, and thus preferably extend the entire length of the first element 44. Each barb 82 has a relatively sharp edge 82*a* (FIG. 3) which extends along the entire length of the barb.

The first element 44 has two parallel portions 111, 112 which project downwardly (as viewed in FIGS. 2 and 3) from the upper portion 54. The portion 111 partially defines the channel 52 and extends throughout the entire extent of the first element 44. The portions 111, 112 have terminal lower ends 113, 114 which lie in a plane containing a terminal lower end 115 of the outer side portion 48. A portion 118 of the first element 44 projects inward from the portion 112 and is parallel to the surface portion 58. A projection 120 projects downwardly, as viewed in FIGS. 2 and 3, from portion 118 and has a terminal end 121 which lies in the plane containing the terminal lower ends 113, 114 of the portions 111, 112 and the terminal lower end 115 of the outer side portion 48. The plane containing these terminal ends is substantially parallel to the surface portions 56, 58.

The part of upper portion 54 having surface portion 58 defines, together with portions 112 and 118, a channel 122. The channel 122 extends the entire length of the first element 44. The edge 30 (FIG. 1) of the picture 14 is received and supported in the channel 122. It should be noted that other materials associated with a framed picture may also be received and supported in the channel 122. Such other materials could include a glass or plastic cover, a picture mat and a picture backing.

The portions 111, 112 have opposed parallel surfaces 134, 136. Surfaces 134, 136 partially define a channel 138. The channel 138 extends the entire length of the first element 44. Ribs 140, 142 extend substantially perpendicular to the surfaces 134, 136 at the terminal lower ends 113, 114 of the portions 111, 112 and extend along the length of the channel 138. Three projections 144, 146, 148 extend into the channel 138. The projections 144, 146, 148 extend along the entire length of the first member 44. The projections 144, 148 extend substantially perpendicular to the surfaces 134, 136, respectively, and parallel to and spaced from the ribs 140, 142. The projection 146 extends substantially perpendicular to the surfaces 64, 66 and is located centrally between surfaces 134, 136.

The border member 20 also includes a second element 88 which extends for the entire length of the first element 44 and which has a different aesthetic appearance than the first element 44. The second element 88 may be made of a variety of materials, such as metal, plastic or wood. In the preferred embodiment, the second element 88 is made of wood which has been stained. The appearance of the wood of the second element 88 is different from the appearance of the anodized aluminum of the first element 44.

The second element 88 has an upper (as viewed in FIGS. 2 and 3) portion 90 which is configured into a shape which is aesthetically pleasing. In the preferred embodiment, the upper portion 90 is rounded in profile. Nonetheless, the upper portion 90 can have any desired configuration. The upper portion 90 faces in the same direction the picture 14 and surfaces 56, 58 face.

The second element 88 has a lower portion 98 which extends into the recess 72 of the first element 44. The recess 72 is sufficiently deep that part of the upper portion 90 of the second element 88 lies against the surface portions 56, 58 of the first element 44.

The second element 88 has surfaces 100, 102, 104 (FIG. 3) which define an elongate groove 108 located centrally of the lower portion 98. The groove 108 extends the entire length of the second element 88. The projection 78 (FIG. 2) extends into the groove 108. The groove 108 is sufficiently narrow that the barbs 82 of the projection 78 frictionally engage the material of the second element 88 within the groove 108. The edges **82*a* of the barbs 82 penetrate into the material of the second element 88 and lockingly engages the second element to secure the first and second elements 44, 88 together and prevent relative movement between the elements 44, 88. The barbs 82 slightly deform and grip the wood material of the element 88 to prevent the first and second elements 44, 88** from moving relative to each other in any direction.

Figure 4:
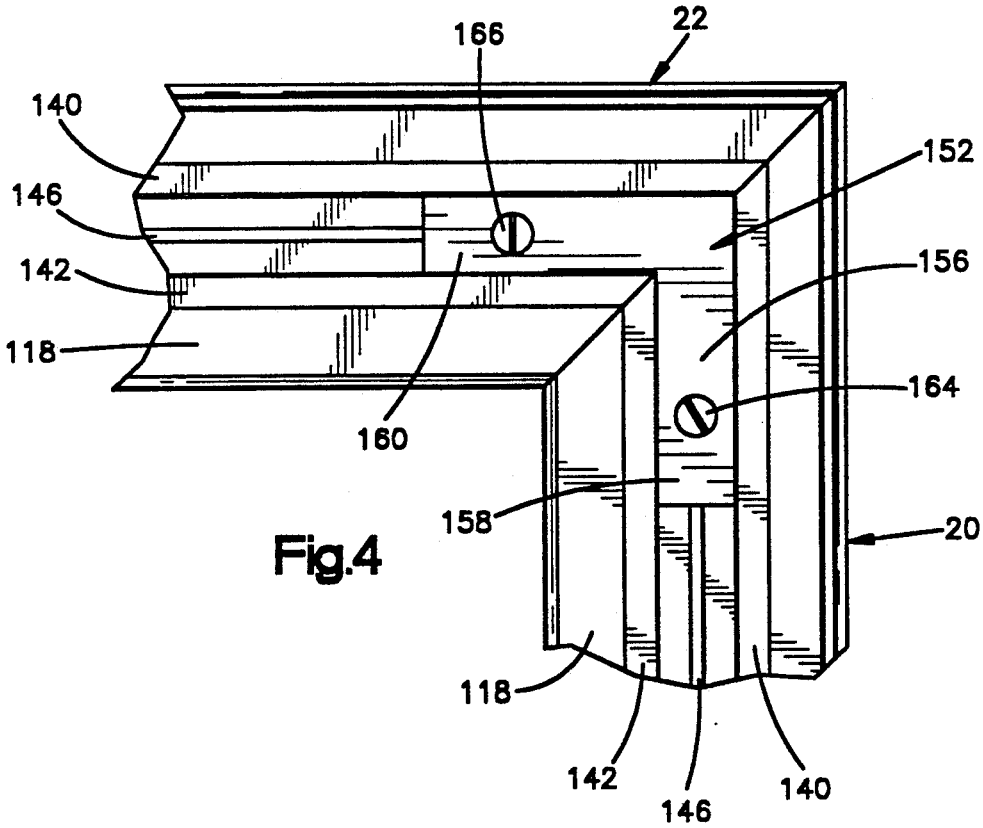
FIG. 4 is an enlarged, partial, pictorial illustration showing the reverse side of a portion of the frame shown in FIG. 1.

Retainer members 152 (only one of which is shown in FIGS. 2 and 4) connect the four border members 20, 22, 24, 26 together to maintain the border members 20, 22, 24, 26 in engagement with each other and with the picture 14. The retainer members 152 can be of any construction. In the preferred embodiment, each retainer member 152 includes a known L-shaped part for connecting the border members 20, 22, 24 and 26 at the corners of the frame 10. Because each of the corners of the picture frame unit 10 has a similar connection, only the connection between members 20 and 22 will be described.

The retainer member 152 (FIGS. 2 and 4) for connecting border members 20 and 22 includes two L-shaped plates 155, 156. The L-shaped plate 155 has a first arm which extends into the channel 138 of border member 20 and a second arm which extends into the channel 138 of the border member 22. These arms engage the ribs 144, 148 and the projection 146 of the first element 44. The L-shaped plate 156 has a first arm 158 which extends into the channel 138 of the border member 20 and a second arm 160 which extends into the channel 138 of the border member 22. Set screws 164, 166 are screwed into threaded apertures formed in the arms 158, 160, respectively, of the L-shaped plate 156 so that the ends of the screws abut the L-shaped plate 155. By turning the set screws 164, 166, the L-shaped plate 156 is forced into tight frictional engagement with the ribs 140, 142 on the border members 20, 22 and the L-shaped plate 155 is forced into tight frictional engagement with the ribs 144, 148 and the projection 146 on the border members 20, 22. This locks the border members 20, 22 together.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for bordering a member, said apparatus comprising:

a first element for engagement with the member, said first element having an elongate recess; and a second element having a different aesthetic appearance than said first element, said second element including a portion disposed within the recess, said first element including means for lockingly engaging said portion disposed within the recess to prevent relative movement between said first and second elements, said means for lockingly engaging including means for penetrating said second element to lock said first and second elements together.

2. An apparatus as set forth in claim 1 wherein said means for lockingly engaging said portion within the recess comprises a barb, said barb partially penetrating said portion within the recess to grip and hold said portion within the recess.

3. An apparatus as set forth in claim 1 wherein said first element includes a projection, said projection being within the recess, said barb being on said projection.

4. An apparatus as set forth in claim 3 wherein said portion of said second element which extends into said recess of said first element includes means defining a groove, said barb being positioned within said groove.

5. An apparatus as set forth in claim 1 wherein said second element includes a portion positioned external to the recess, each of said first and second elements having a width measured from a first side to a second side and perpendicular to the longitudinal extent of the recess, the width of said first element being greater than the width of said second element, said second element being positioned relative to said first element such that the width of said second element partially overlaps the width of the first element, said first element extending beyond the first and second sides of said second element.

6. An apparatus as set forth in claim 1 wherein said first element includes outer surface portions positioned on either side of the recess, said second element partially overlapping said outer surface portions, said outer surface portions extending beyond said second element.

7. An apparatus as set forth in claim 1 wherein said first element includes a portion for partially extending over the member, said first element also includes a portion for partially extending under the member, said portions partially extending over and under the member defining a channel for receiving and supporting the member.

8. An apparatus as set forth in claim 1 wherein said first element includes a portion extending to partially cover the member, said second element extending to partially cover said portion of said first element.

9. As apparatus for bordering a member, said apparatus comprising:

a first element for engagement with the member, said first element having an elongate recess; and a second element having a different aesthetic appearance than said first element, said second element including a portion disposed within the recess, said first element including means for lockingly engaging said portion disposed within the recess to prevent relative movement between said first and second elements, said means for lockingly engaging including means for penetrating said second element to lock said first and second elements together, said means for lockingly engaging said portion within the recess comprises a barb, said barb partially penetrating said portion within the recess to grip and hold said portion within the recess, said second element, said recess, said projection and said barb extend the entire length of said first element.

10. An apparatus for bordering a member, said apparatus comprising:

a first element for engagement with the member, said first element including surface means defining an elongate recess; and a second element having a aesthetic appearance different than said first element, said second element including a portion which extends into said recess of said first element;

said first element having means for lockingly engaging said second element to secure said first and second elements together and prevent relative movement between said first and second elements, said means for lockingly engaging comprising a barb, said barb partially penetrating said portion of said second element with the recess to grip and hold said portion of said second element within the recess, said second element including a portion positioned external to the recess, each of said first and second elements having a width measured from a first side to a second side and perpendicular to the longitudinal extent of the recess, the width of said first element being greater than the width of said second element, said second element being positioned relative to said first element such that the width of said second element partially overlaps the width of the first element, and said first element extending beyond the first and second sides of said second element.

11. An apparatus as set forth in claim 10 wherein said first element includes a portion for restraining the member, said portion of said first element extends to partially cover the member, said second element extending to partially cover said portion of said first element.

12. An apparatus as set forth in claim 10 wherein said first element includes a portion for partially extending over the member, said first element also includes a portion for partially extending under the member, said portions partially extending over and under the member defining a channel for receiving and supporting the member.

13. An apparatus for bordering a member, said apparatus comprising:

a first element for engagement with the member, said first element including surface means defining an elongate recess; and a second element having a aesthetic appearance different than said first element, said second element including a portion which extends into said recess of said first element;

said first element having means for lockingly engaging said second element to secure said first and second elements together and prevent relative movement between said first and second elements, said means for lockingly engaging comprising a barb, said barb partially penetrating said portion of said second element with the recess to grip and hold said portion of said second element within the recess, said first element including projection, said projection being within the recess, said barb being on said projection;

said second element including a portion positioned external to the recess, each of said first and second elements having a width measured from a first side to a second side and perpendicular to the longitudinal extent of the recess, the width of said first element being greater than the width of said second element, said second element being positioned relative to said first element such that the width of said second element partially overlaps the width of the first element, and said first element extending beyond the first and second sides of said second element.

14. An apparatus as set forth in claim 13 wherein said second element, said recess, said projection and said barb extend along the entire length of said first element.

15. An apparatus as set forth in claim 13 wherein said portion of said second element defines a groove, said barb of said first element being positioned within said groove.

* * * * *